US005146854A

United States Patent [19]

Poulos

[11] Patent Number: 5,146,854

[45] Date of Patent: Sep. 15, 1992

[54] SUSPENDED PERSONNEL CARRIER WITH ARTICULATED FRONT AND REAR PORTIONS STEERABLE INDEPENDENTLY OF TRACK CURVATURE AND TELESCOPIC SHOCK ABSORBING STRUT FOR TRANSFERRING DRIVE FORCE

[76] Inventor: Philip Poulos, 3319 Candlewood Dr., Hampton, Va. 23666

[21] Appl. No.: 699,141

[22] Filed: May 13, 1991

[51] Int. Cl.[5] ..... B61B 3/02

[52] U.S. Cl. ..... 105/150; 105/3; 105/139; 104/93

[58] Field of Search ..... 104/53, 89, 93, 110, 104/118, 138.1; 105/1.3, 3, 66, 141, 148, 150, 133, 138, 139

[56] References Cited

U.S. PATENT DOCUMENTS

| | | | |
|---|---|---|---|
| 397,902 | 2/1889 | Elliott | 105/3 |
| 1,975,910 | 10/1934 | Trott | 105/139 |
| 2,997,003 | 8/1961 | Thompson | 104/93 |
| 3,120,197 | 2/1964 | Cirami | 104/245 |
| 3,353,503 | 11/1967 | Pettit | 105/150 |
| 3,361,084 | 1/1968 | Ellzey | 104/89 X |
| 3,534,689 | 10/1970 | Barthalon | 104/89 |
| 3,698,326 | 10/1972 | Schurch et al. | 104/93 X |
| 3,739,424 | 6/1973 | Gonsalves | 104/93 X |
| 4,520,732 | 6/1985 | Schwarzkopf | 104/89 X |
| 4,641,587 | 2/1987 | Dalliard | 105/3 |

FOREIGN PATENT DOCUMENTS

| | | | |
|---|---|---|---|
| 218512 | 3/1957 | Australia | 104/93 |
| 2225845 | 7/1978 | Fed. Rep. of Germany | 104/89 |
| 2097349 | 11/1982 | United Kingdom | 104/89 |

OTHER PUBLICATIONS

Popular Mechanics-Mar. 1991, p. 17.

*Primary Examiner*—Robert J. Oberleitner
*Assistant Examiner*—S. Joseph Morano
*Attorney, Agent, or Firm*—Jerry T. Kearns

[57] ABSTRACT

A suspended personnel carrier includes an elevated cylindrical track from which a carrier is suspended for translation by a bearing assembly. The bearing assembly includes orthogonal rollers which ride along the cylindrical track. The carrier is propelled along the track through a fan drive system including a propeller and a motor. The frame of the carrier is divided into front and rear portions connected by a hinge. A crossed parallelogram linkage suspension connects the front and rear portions, such that turning of the front portion by manual manipulation of a handlebar assembly effects a mirror image movement of the rear portion. The drive motor and propeller are coupled to the frame of a carrier by a slip rail assembly, and to the bearing assembly by a shock absorbing telescoping linkage, such that drive force is first transmitted to the bearing assembly, rather than the frame. This arrangement causes the bearing assembly to pull the carrier, rather than the carrier pushing the bearing assembly, resulting in smoother, more controlled ride around the track.

20 Claims, 9 Drawing Sheets

SUSPENDED PERSONNEL CARRIER WITH ARTICULATED FRONT AND REAR PORTIONS STEERABLE INDEPENDENTLY OF TRACK CURVATURE AND TELESCOPIC SHOCK ABSORBING STRUT FOR TRANSFERRING DRIVE FORCE

BACKGROUND OF THE INVENTION

The present invention relates to suspended personnel carriers, and more particularly pertains to an improved suspended personnel carrier designed to provide an entertaining amusement ride.

SUMMARY OF THE INVENTION

In order to achieve these and other objects of the invention, the present invention provides an improved suspended personnel carrier which includes an elevated cylindrical track from which a carrier is suspended for translation by a bearing assembly. The bearing assembly includes orthogonal rollers which ride along the cylindrical track. The carrier is propelled along the track through a fan drive system including a propeller and a motor. The frame of the carrier is divided into front and rear portions connected by a hinge. A crossed parallelogram linkage suspension connects the front and rear portions, such that turning of the front portion by manual manipulation of a handlebar assembly effects a mirror image movement of the rear portion. The drive motor and propeller are coupled to the frame of a carrier by a slip rail assembly, and to the bearing assembly by a shock absorbing telescoping linkage, such that drive force is first transmitted to the bearing assembly, rather than the frame. This arrangement causes the bearing assembly to pull the carrier, rather than the carrier pushing the bearing assembly, resulting in a smoother, more controlled ride around the track. There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
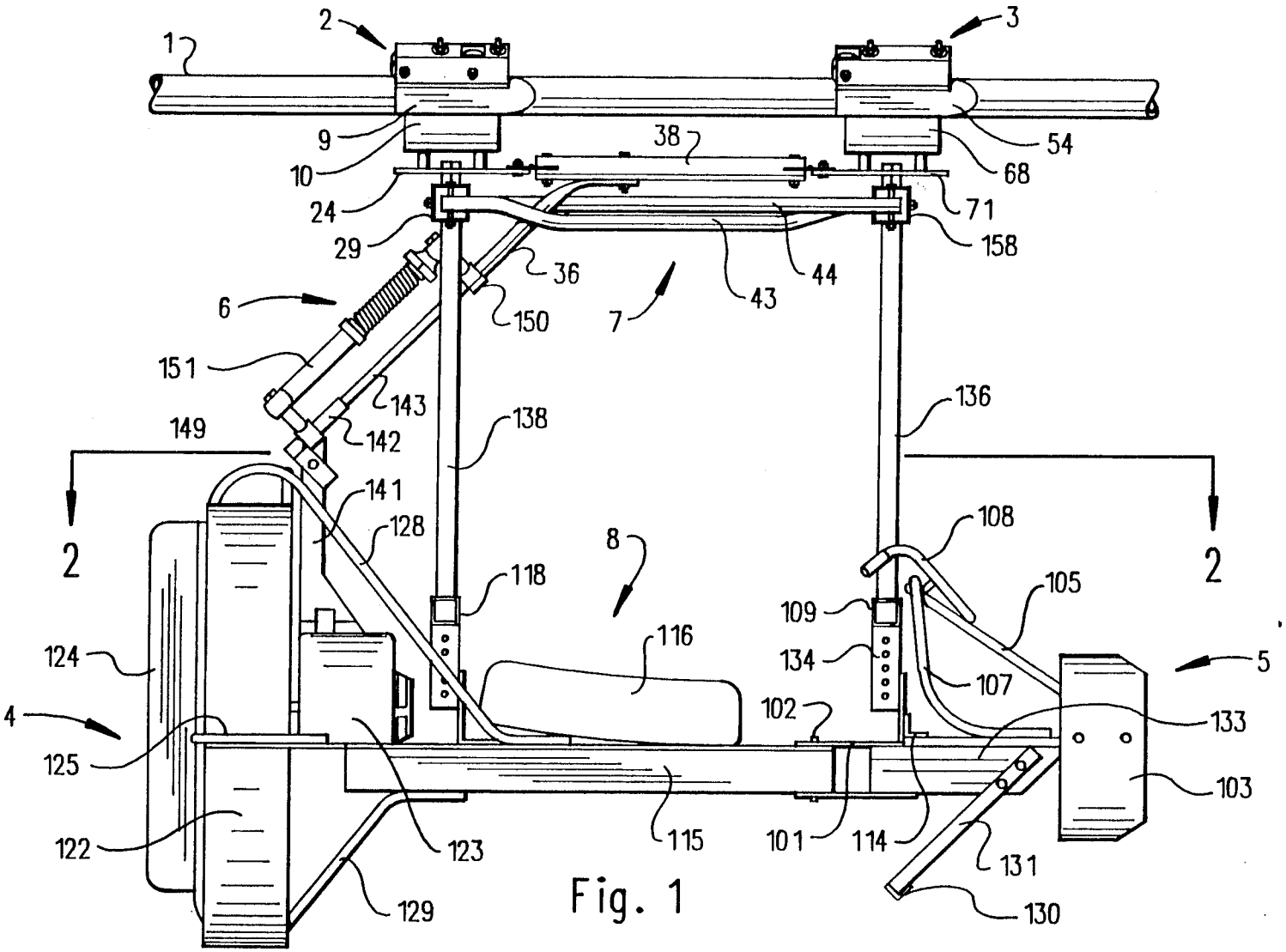
FIG. 1 is a side elevational view of the suspended personnel carrier according to the present invention.

Referring now to the drawings, wherein like reference numerals designate corresponding structure throughout the views, and referring in particular to FIG. 1, an improved suspended personnel carrier 10 according to a first preferred embodiment of the invention includes a cylindrical rail track 1 preferably formed by a metal tube, although suitable plastic materials may also be employed. Rear 2 and front 3 roller bearing assemblies are disposed for movement along the elevated track 1. The suspended carrier includes a front portion 5 provided with a steering assembly, and a rear portion 4 possessing a drive assembly and a rider position 8. Drive force is transmitted to the rear 2 and front 3 bearing assemblies by a strut assembly 6. A suspension linkage assembly 7 suspends the carrier from the bearing assemblies 2 and 3. As can be appreciated from FIG. 3, the carrier is mounted for movement around a closed loop path formed by the track 1.

Figure 9:
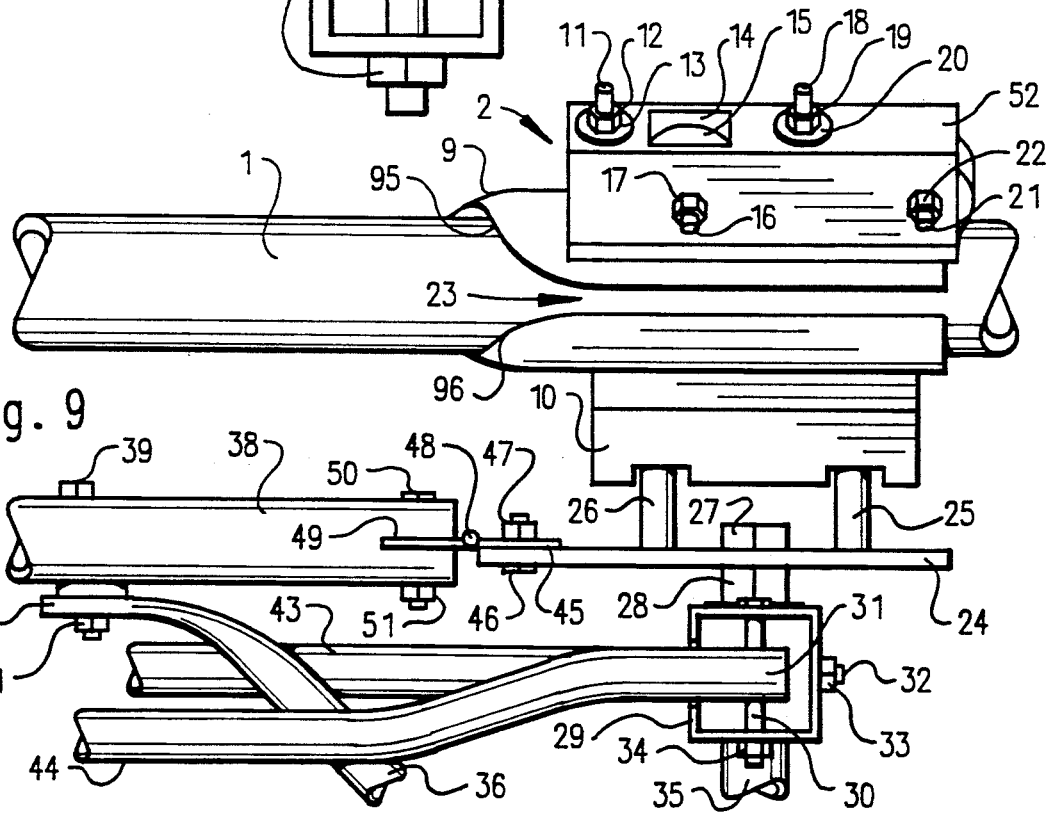
FIG. 9 is a side elevational detail view further illustrating the carrier bearing and suspension assembly.
Figure 11:
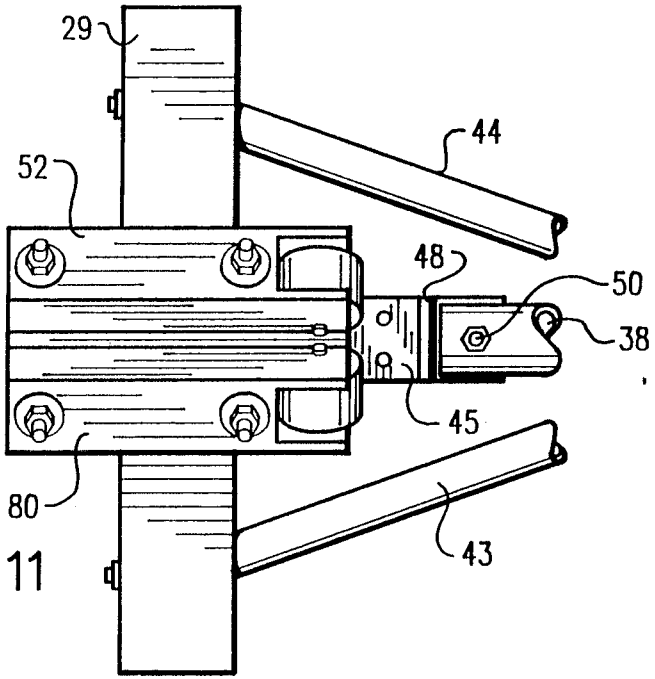
FIG. 11 is a top plan detail view illustrating the bearing and suspension assembly.

With reference to FIGS. 1 and 9, the rear bearing assembly 2 includes a generally cylindrical guide sleeve 9 dimensioned for sliding movement along the track 1.

A box beam 10 connects the guide sleeve 9 to the carrier suspension assembly 7. Fastening members including bolts 11, 18, nuts 12, 19, and washers 13, 20 serve to connect bearing cage 52 to the guide sleeve 9. A roller 15 is mounted for rotation in a slot 14 on an axle 16 secured by nut 17. The roller 15 provides a low-friction bearing which rolls along the track 1. A similar roller is mounted in the cage 52 by an axle 21 secured by nut 22. The sleeve 9 includes a longitudinal slot or gap 23, and is thus not completely cylindrical.

The box beam 10 is secured to the guide sleeve 9. Hollow rods 25 and 26 pass through slots in the box beam 10 and connect reinforcing tube 81 (FIG. 5) to plate 24 by a bolt and nut type threaded connection. The plate 24 is in turn pivotally secured to a cross bar 29 by pivot bolt 27 and nut 28. A pivot bolt 30 extends through an end 31 of link 44, through the cross bar 29, and is secured by nut 34. A pair of vertical suspension rods 35 and 138 are rigidly secured to the cross bar 29, for example by bolt 32 and nut 33. A tab end 37 on a drive link 36 is secured to a connecting bar 38 by bolts 39, 40 and nuts 41, 42. An end of link 43, similar to link 44, is secured to an opposite end of the cross bar 29 from link 44 in a manner identical to the securement of the end 31 of link 44. A first hinge tab 45 is secured to plate 24 by bolt 46 and nut 47. A second tab 49 of the hinge is secured in a slot formed in the end of bar 38 by bolt 50 and nut 51. The tabs 45 and 49 are connected by hinge pin 48, such that the bar 38 is hinged to the plate 24.

Figure 8:
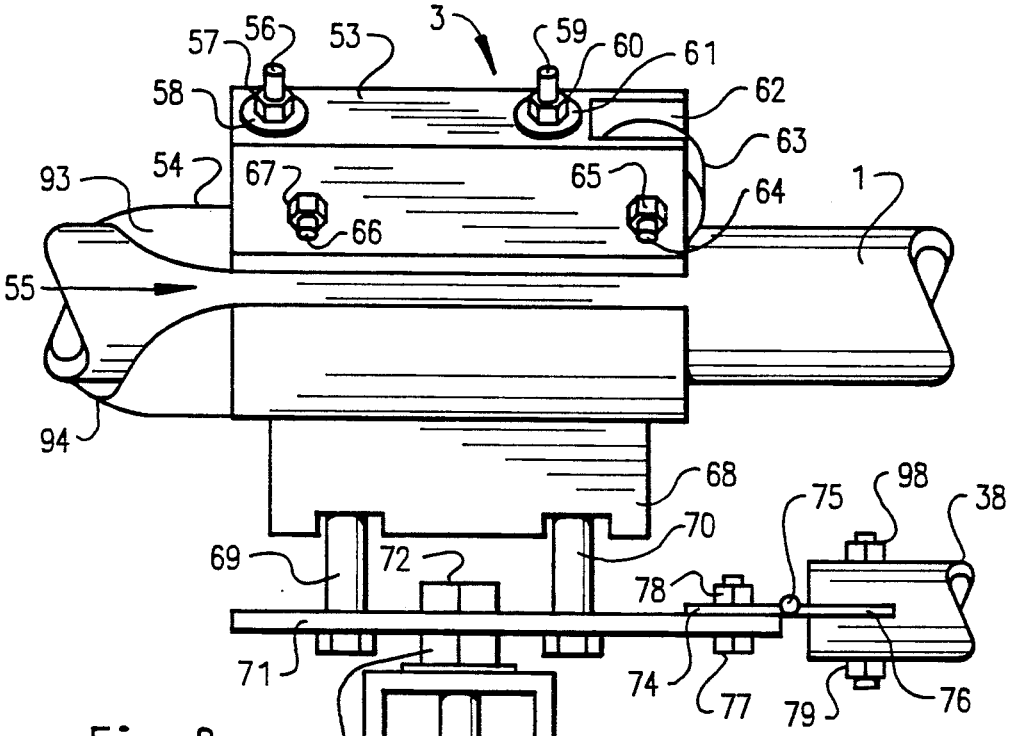
FIG. 8 is a side elevational detail view illustrating the carrier bearing and suspension assembly.

As can be appreciated from FIG. 8, the front bearing assembly 3 has a construction substantially similar to that of rear bearing assembly 2, and includes a bearing cage 53 secured to a guide sleeve 54 by bolts 56, 59, nuts 57, 60, and washers 58, 61. The guide sleeve 54 has a longitudinal slot or gap 55, and is thus not completely cylindrical. A roller 63 is mounted in a slot 62 for rotation on an axle 64 secured by a nut 65. A similar roller is mounted for rotation on an axle 66 secured by a nut 67. A box beam 68 secured to the guide sleeve 54. Reinforcing tube 81 is secured by rods 69 and 70 to a plate 71. The plate 71 is pivotally secured to a cross bar 158 by a pivot bolt 72 and nut 73. A hinge tab 74 is secured to the plate 71 by bolt 77 and nut 78. An opposite hinge tab 76 is secured in a slot in the end of bar 38 by bolt 98 and nut 79. The hinge tabs 74 and 76 are pivotally connected by a hinge pin 75. Thus, the plate 71 is hinged to the bar 38.

Figure 3:
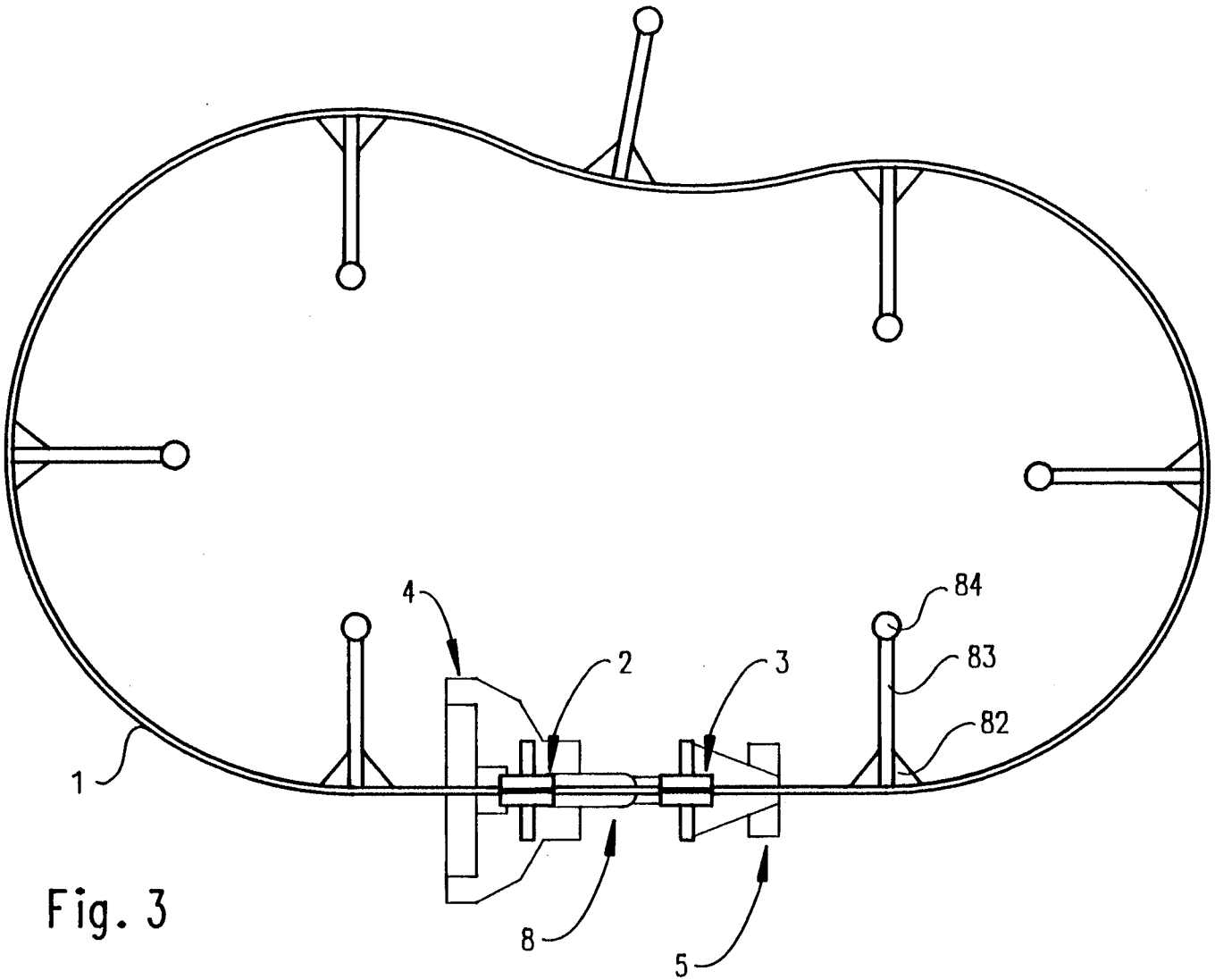
FIG. 3 is a top plan view illustrating the suspended personnel carrier mounted on the elevated supporting track.
Figure 5:
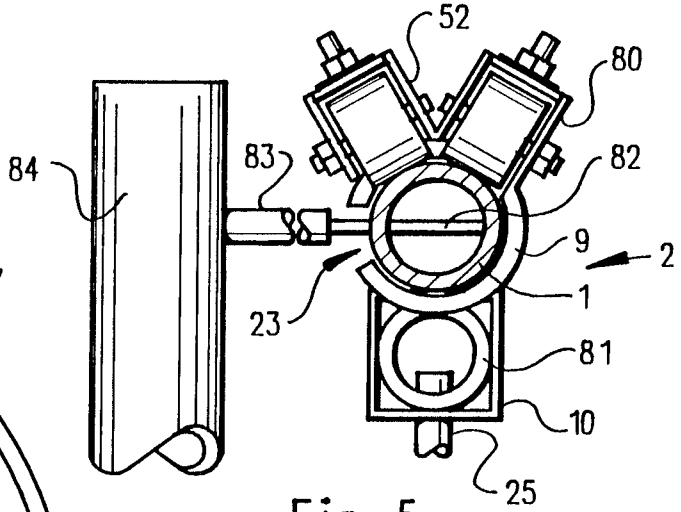
FIG. 5 is a detail view, partially in cross section, illustrating the supporting bearing assembly of the suspended personnel carrier disposed on a portion of straight track.
Figures 6, 7:
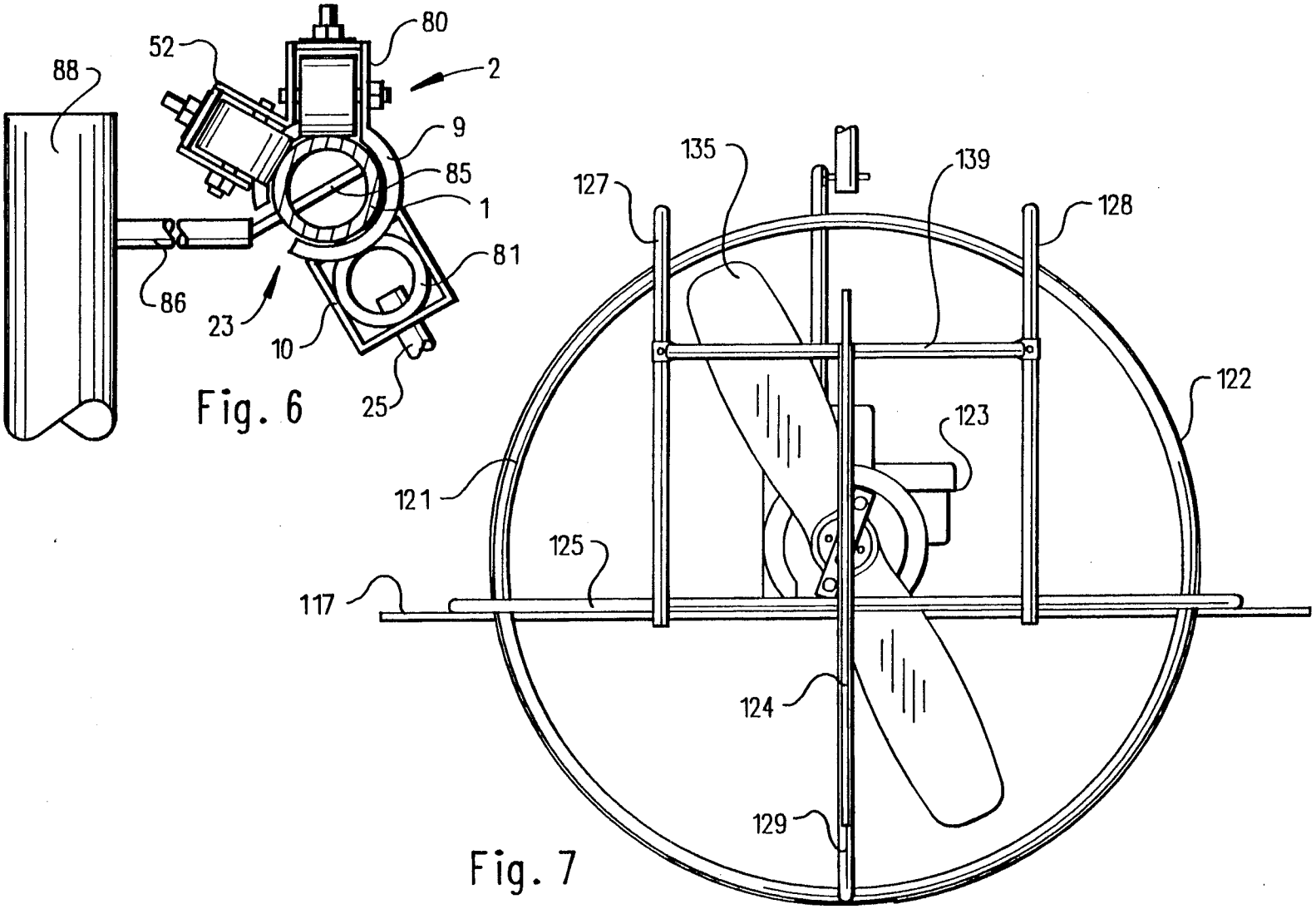
FIG. 6 is another detail view, similar to FIG. 5, partially in cross section, illustrating the track support at points of track curvature.
FIG. 7 is a rear view illustrating the suspended personnel carrier of the present invention.
Figure 13:
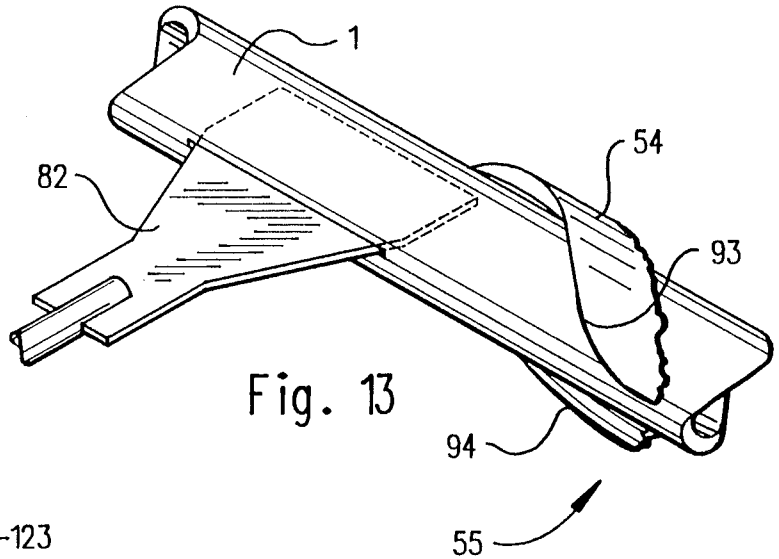
FIG. 13 is a perspective detail view illustrating the track supporting strut and bearing assembly.

As shown in FIGS. 5 and 6, the front bearing assembly 2 includes two substantially perpendicular roller bearing cages 52 and 80, with each cage rotatably mounting a pair of rollers which engage the surface of the track 1. The rear bearing assembly 3 has a substantially identical construction, also including two perpendicular roller bearing cages. A reinforcing tube 81 is disposed within the box beam 10. The track 1 is supported in an elevated position by a plurality of posts 84, as shown in FIG. 3. The posts include a rail mount bar 83 which terminates in a connecting strut 82. As shown in FIG. 13, the strut 82 extends laterally into the track 1, and is secured thereto. The gaps 23 and 55 in the guide sleeves 9 and 54 allow the guide sleeves to pass the posts 84 without hitting the struts 82. To this end, the forward edges 93 and 94 of the sleeve 54 and the forward edges 95, 96 (FIG. 9) of the sleeve 9 are arcuately curved, so as to smoothly guide the struts 82 into the gaps 23 and 55 by the action of the guide sleeve pivoting about its own axis.

Figure 14:
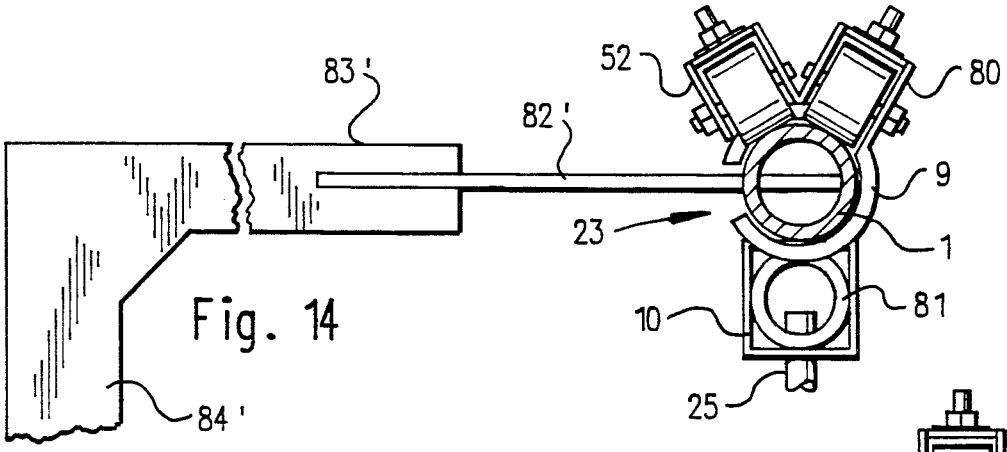
FIG. 14 is a detail view, partially in cross section, illustrating the disposition of the bearing assembly on a horizontal track section supported by a horizontal strut assembly.
Figure 15:
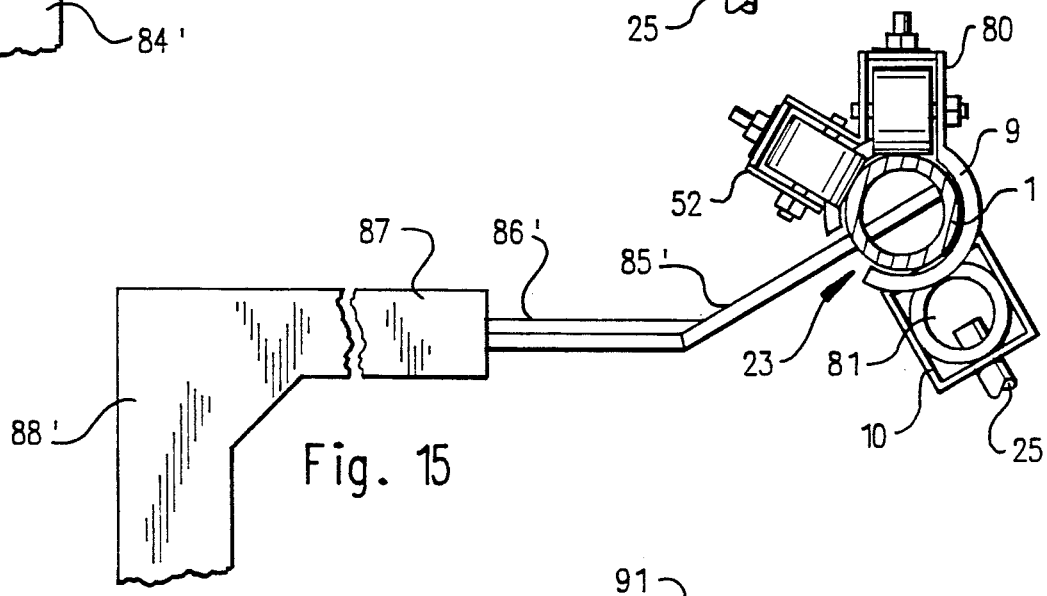
FIG. 15 is a detail view, partially in cross section, illustrating the disposition of the bearing assembly on an upwardly inclined strut assembly.
Figure 16:
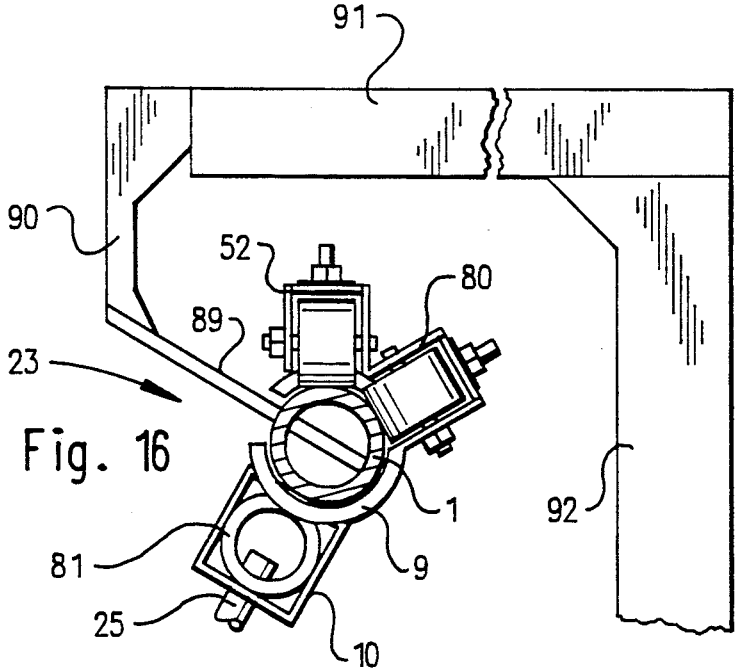
FIG. 16 is a detail view, partially in cross section, illustrating the disposition of the bearing assembly on a downwardly inclined strut assembly.

As shown between FIGS. 5 and 6, the connecting strut 82 may be replaced by an upwardly angled strut 85 supported on a post 88 by a rail mount bar 88. Similarly, as shown in FIG. 16, a downwardly angled connecting strut 89 may be secured on a downwardly extending leg 90 secured to a cross arm 91 of a post 92. Other alternative post constructions are shown in FIGS. 14 and 15, and include posts 84' and 88' having cross arms 83' and 87 and struts 82', 85' and 86'. It is contemplated that the various different post and rail mounting configurations illustrated in FIGS. 5, 6 and 14–16 will be employed in the construction of a track having a closed loop, curved path. Thus, support struts are always placed at points of track curvature since centrifugal force acting on the vehicle will produce maximum stress at these points. In anticipation of the angular position of the vehicle as it will swing out or 'bank' in the curve, the struts 82 are inclined to minimize the corrective action of guide sleeve 9 as it passes by strut 82.

Figure 2:
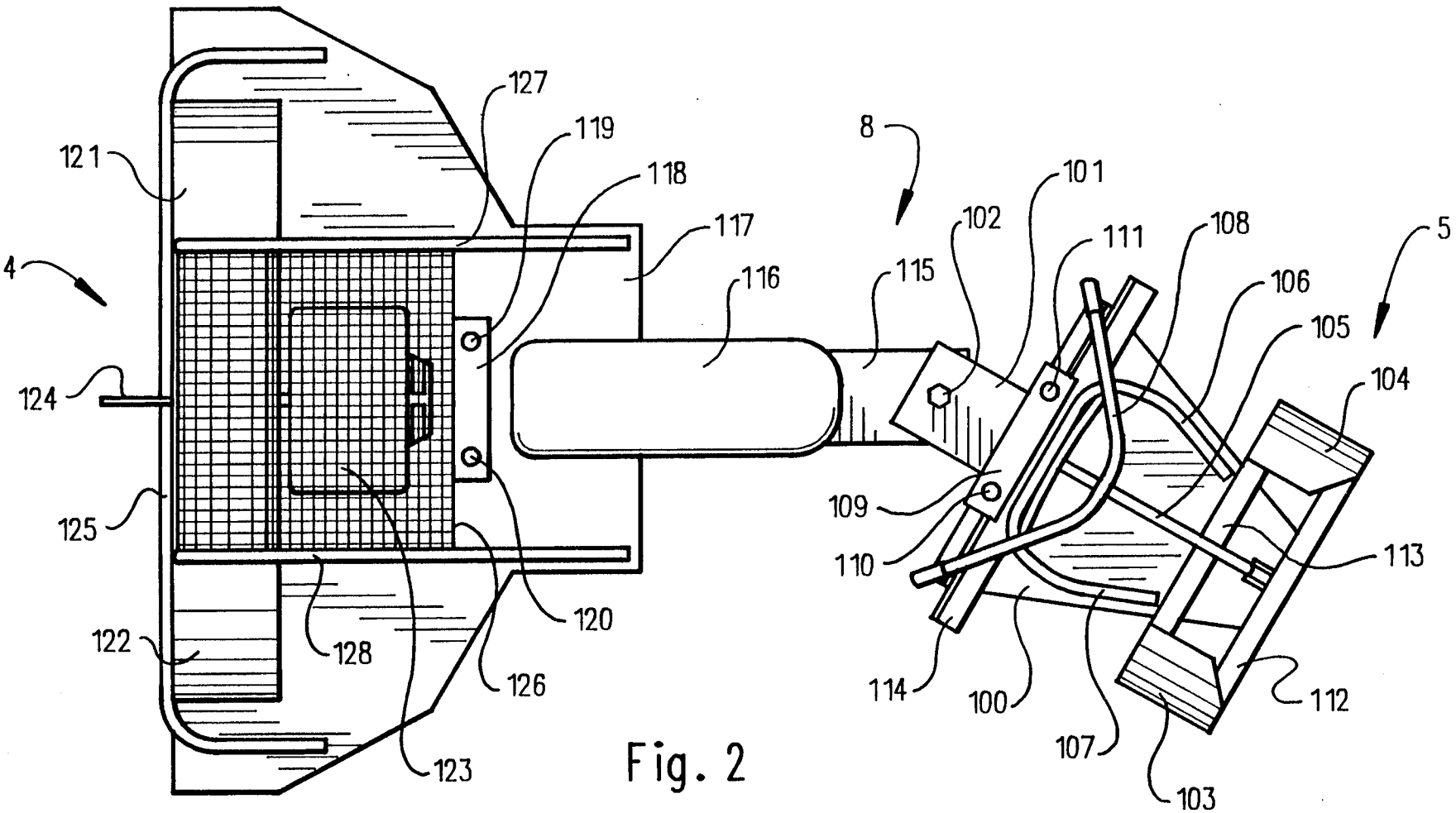
FIG. 2 is a top plan view illustrating the suspended personnel carrier of the present invention.
Figure 4:
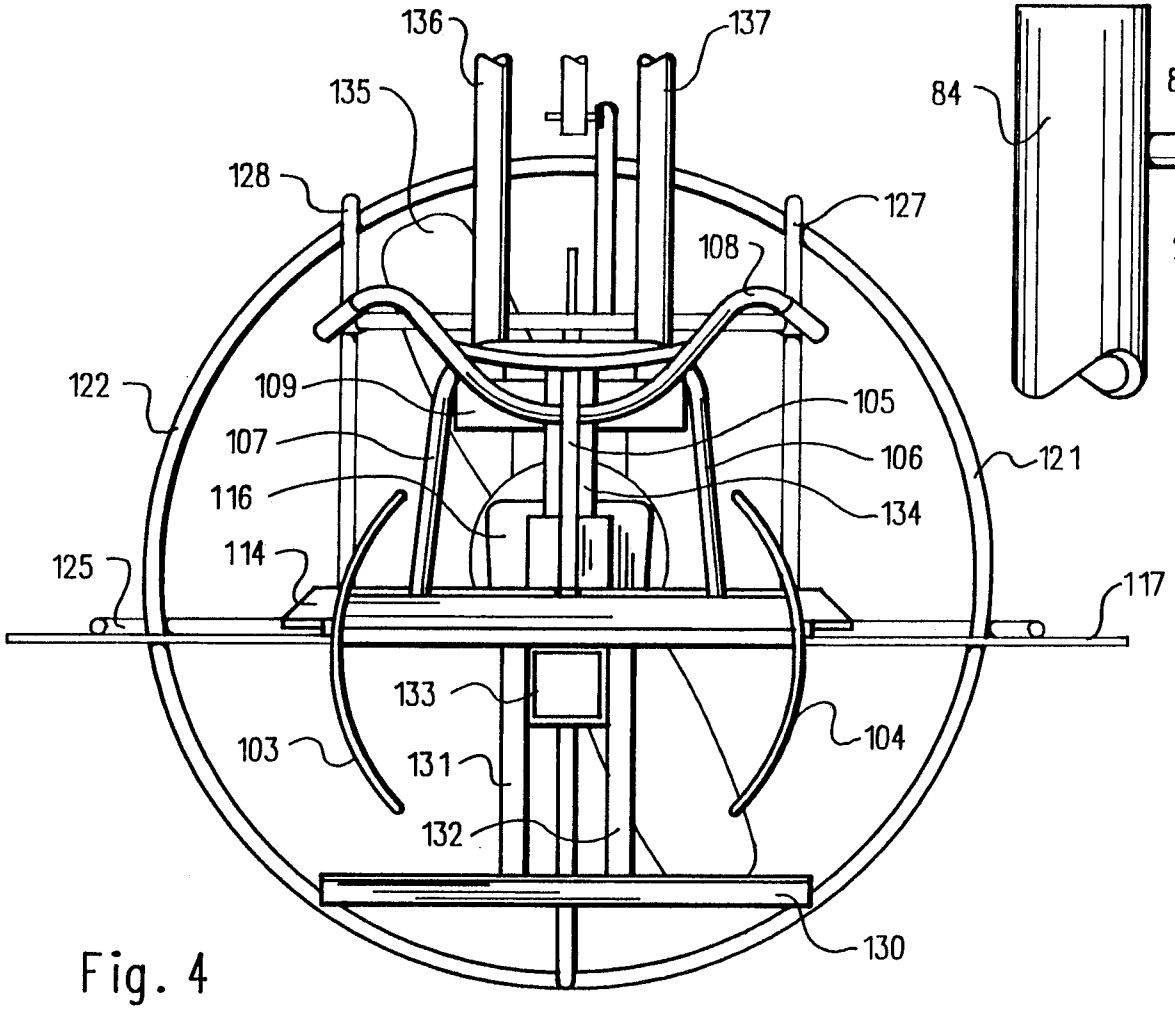
FIG. 4 is a front view illustrating the suspended personnel carrier of the present invention.

With reference to FIGS. 1, 2 and 4, the front portion 5 of the carrier includes a steering assembly frame plate 100 secured to a pivot yoke 101 which is pivotally mounted by a bolt 102 to the frame 115 of the rear portion 4 of the carrier. Faring members 103 and 104 are secured to the frame plate 100 by supports 112, 113. The faring members 103 and 104 also serves as air rudders to assist in steering the carrier. A handle bar 108 is secured to the plate 100 by supports 105, 106, 107. A support bar 109 is secured to the yoke 101 by beams 114 and 134, and includes sockets 110 and 111 which receive right front vertical support rod 136 and left front vertical support rod 137 (FIG. 4). A seat 116 is secured on the frame 115.

As shown in FIGS. 2, 4 and 7, a support bar 118 is secured on a motor platform 117 toward the rear of the carrier, and includes sockets 119 and 120 for left rear vertical support rod 35 (FIG. 9) and right rear vertical support rod 138 (FIG. 1). Baffles 121 and 122 surround a propeller 135 driven by motor 123. A vertical stabilizer 124 is mounted by supports 125, 127, 128, 129, 139, which also mount a protective screen 126. A foot rest 130 is secured to frame beam 133 by struts 131 and 132.

Figure 10:
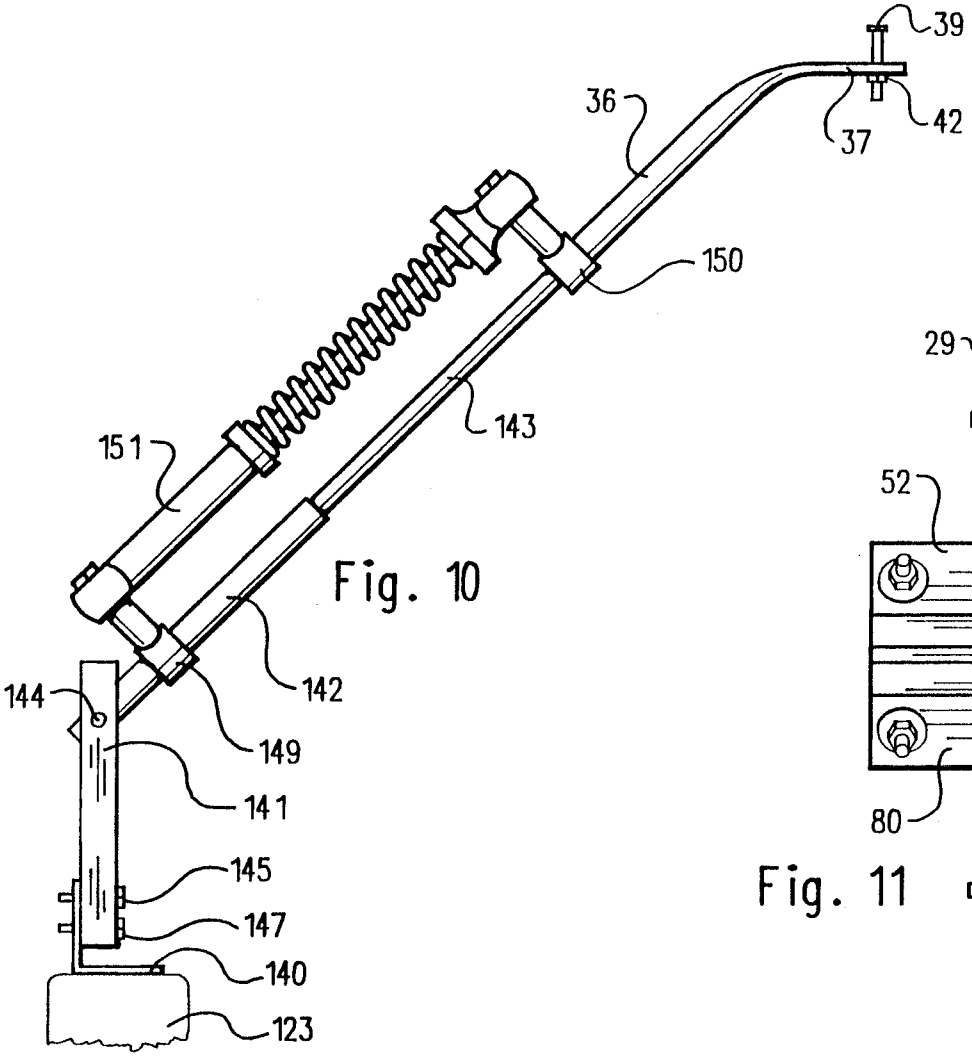
FIG. 10 is a side elevational detail view illustrating the shock absorbing drive linkage between the bearing assembly and the drive motor.
Figure 12:
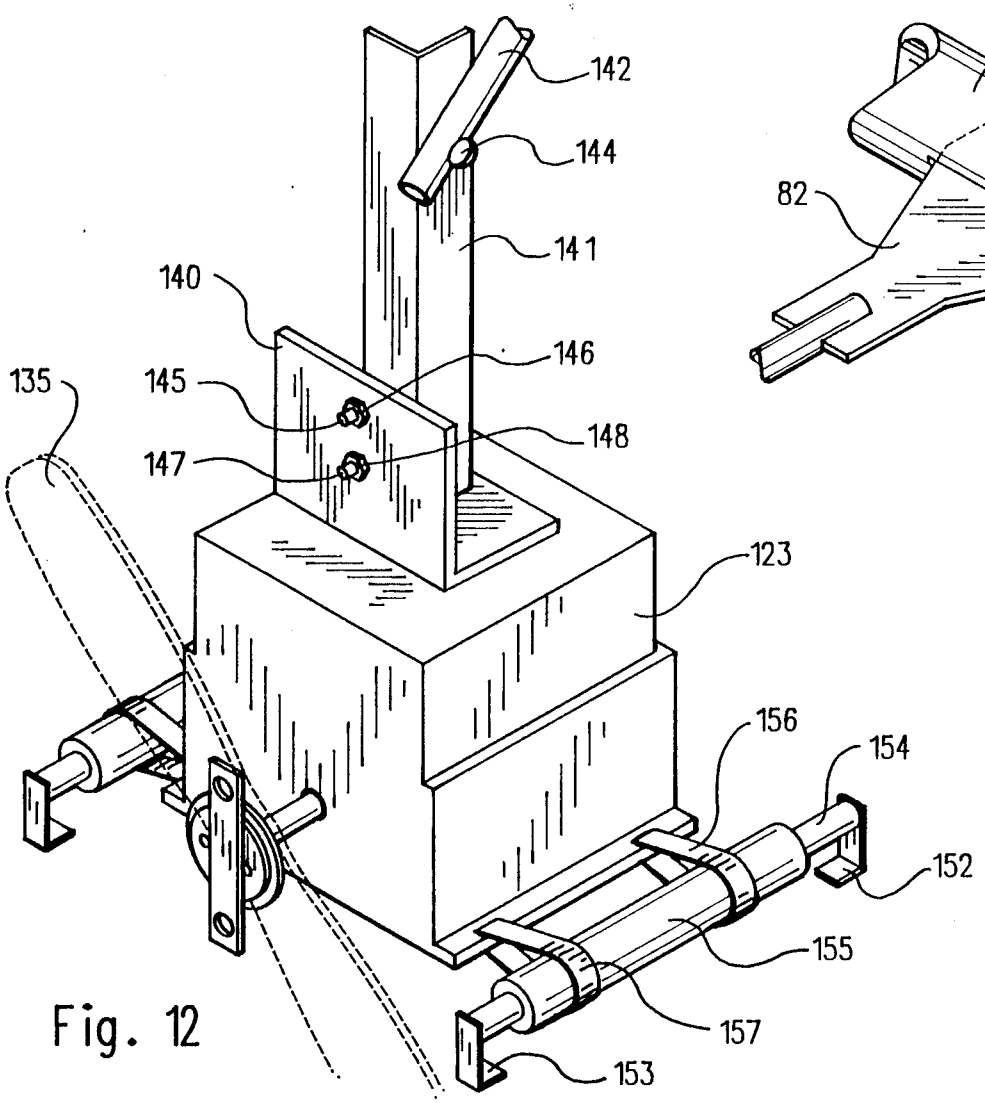
FIG. 12 is a perspective detail view illustrating the mounting of the drive motor for limited reciprocal movement on the carrier.

As shown in FIGS. 10 and 12, a right angle bracket 140 is secured to the top of motor 123. A vertical beam 141 is secured to the bracket 140 by bolts 145, 147 and nuts 146, 148. A link member 142 is pivotally secured to the beam 141 by a bolt 144. The link 142 is hollow, and telescopically receives a lower end of link 143. An upper end of link 143 is telescopically received in link 36. A shock absorber 151 is secured between links 36 and 142 by clamps 150 and 149, such that a shock absorbing linkage is formed to transmit drive force from the motor 123 to the bar 38 (FIG. 1). To prevent drive force produced by the thrust of propeller 135 from being first transmitted to the carrier, brackets 152 and 153 support a guide bar 154 on the platform 117 (FIG. 2). A sliding sleeve 155 is mounted for limited reciprocal movement along the bar 154. The motor is secured for movement with the sleeve 155 by band clamps 156 and 157. An identical arrangement supports the opposite side of the motor 123. Thus, the thrust from the propeller 135 will be transmitted to the bearing assemblies via the link 36 and bar 38, causing the bearing assemblies to pull the carrier along the track, rather than have the carrier push the bearing assemblies along the track. This results in a smoother, more controlled ride.

As can now be appreciated, the present invention provides a suspended carrier, divided into front 5 and rear 4 portions which are pivotally connected for relative movement about the axis of bolt 102 (FIG. 1). A first pair of front vertical support rods 136, 137 suspend the front portion 5 of the carrier from cross bar 158. A second pair of rear vertical support rods 138, 135 suspend the rear portion 4 of the carrier from the cross bar 29. Cross bars 29, 158 and links 43 and 44 form a crossed parallelogram linkage. Thus, movement of the front 5 of the carrier by handle bar 108 or caused by track curvature will result in a mirror image movement of the rear portion 4 of the carrier.

While the invention has been described with reference to securement by threaded fasteners, it should be understood that the various fixed components may be otherwise secured, for example by welding. Similarly, a variety of materials, such as aluminum, steel, magnesium, plastic, etc. may be employed, without departing from the scope of the invention.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A personnel carrier, comprising:

an elevated track;

a carrier suspended beneath said track, said carrier including front and rear portions connected for relative movement about a substantially vertical axis;

steering means for manually moving said front portion of said carrier about said substantially vertical axis;

front and rear bearing assemblies supporting said carrier for movement along said track;

a first pair of substantially vertical rods connecting said front portion of said carrier to said front bearing assembly and a second pair of substantially vertical rods connecting said rear portion of said carrier to said rear bearing assembly;

a crossed parallelogram linkage connecting said first and second pairs of vertical rods such that movement of said front portion of said carrier about said vertical axis is substantially mirrored by movement of said rear portion of said carrier;

a fan drive on said carrier for propelling said carrier along said track, said fan drive including a propeller driven by a motor; and means mounting said motor to said bearing assembly including a telescoping shock absorbing strut, such that thrust force exerted on said motor by said propeller is transmitted to said bearing assembly, whereby said carrier is pulled along said track by said bearing assembly.

2. The personnel carrier of claim 1, wherein said steering means comprises a handle bar.

3. The personnel carrier of claim 2, wherein said handle bar is connected to at least one faring member which functions as an air rudder to effect steering.

4. The personnel carrier of claim 1, wherein said steering means is connected to at least one faring member which functions as an air rudder to effect steering.

5. A personnel carrier, comprising:

an elevated track;

a carrier suspended beneath said track;

a bearing assembly supporting said carrier for movement along said track;

a fan drive on said carrier for propelling said carrier along said track, said fan drive including a propeller driven by a motor;

means mounting said motor for limited reciprocal movement on said carrier; and means connecting said motor to said bearing assembly, such that thrust force exerted on said motor by said propeller is transmitted to said bearing assembly, whereby said carrier is pulled along said track by said bearing assembly.

6. The personnel carrier of claim 5, wherein said means connecting said motor to said bearing assembly includes a telescoping shock absorbing strut.

7. The personnel carrier of claim 6, wherein said track is substantially cylindrical and supported by a plurality of struts connected to said track at various different circumferential orientations, said bearing assembly comprising:

at least two pairs of substantially perpendicular rollers;

a sleeve surrounding said track, with said rollers projecting through said sleeve into engagement with said track;

a slot formed in said sleeve dimensioned to allow passage of said struts therethrough; and said sleeve including arcuate forward edges smoothly merging with sidewalls of said slot for aligning said slot with said struts as said sleeve passes along said track.

8. The personnel carrier of claim 5, wherein said carrier includes front and rear portions connected for relative movement about a substantially vertical axis, and further comprising steering means for manually moving said front portion of said carrier about said substantially vertical axis.

9. The personnel carrier of claim 8, wherein said steering means comprises a handle bar.

10. The personnel carrier of claim 9, wherein said handle bar is connected to at least one faring member which functions as an air rudder to effect steering.

11. The personnel carrier of claim 8, wherein said steering means is connected to at least one faring member which functions as an air rudder to effect steering.

12. The personnel carrier of claim 5, wherein said carrier includes front and rear portions connected for relative movement about a substantially vertical axis, and further comprising means connecting said front and rear portions such that movement of said front portion about said substantially vertical axis is substantially mirrored by movement of said rear portion.

13. The personnel carrier of claim 12, further comprising steering means for manually moving said front portion of said carrier about said substantially vertical axis.

14. The personnel carrier of claim 13, wherein said steering means comprises a handle bar.

15. The personnel carrier of claim 14, wherein said handle bar is connected to at least one faring member which functions as an air rudder to effect steering.

16. The personnel carrier of claim 13, wherein said steering means is connected to at least one faring member which functions as an air rudder to effect steering.

17. A personnel carrier, comprising:

an elevated track;

a carrier suspended beneath said track, said carrier including front and rear portions connected for relative movement about a substantially vertical axis;

steering means for manually moving said front portion of said carrier, independently of any track curvature, about said substantially vertical axis;

front and rear bearing assemblies supporting said carrier for movement along said track;

first connecting means connecting said front portion of said carrier to said front bearing assembly;

second connecting means connecting said rear portion of said carrier to said rear bearing assembly;

a crossed parallelogram linkage connecting said first and second connecting means such that movement of said front portion of said carrier about said vertical axis is substantially mirrored by movement of said rear portion of said carrier; and means for propelling said carrier along said track.

18. The personnel carrier of claim 17, wherein said track is substantially cylindrical and supported by a plurality of struts connected to said track at various different circumferential orientations, said bearing assembly comprising:

at least two pairs of substantially perpendicular rollers;

a sleeve surrounding said track, with said rollers projecting through said sleeve into engagement with said track;

a slot formed in said sleeve dimensioned to allow passage of said struts therethrough; and said sleeve including arcuate forward edges smoothly merging with sidewalls of said slot for aligning said slot with said struts as said sleeve passes along said track.

19. The personnel carrier of claim 17, wherein said means for propelling said carrier along said track comprises:

a fan drive on said carrier including a propeller driven by a motor; and means connecting said motor to said at least one of said front and rear bearing assemblies, such that thrust force exerted on said motor by said propeller is transmitted to said at least one bearing assembly, whereby said carrier is pulled along said track by said at least one bearing assembly.

20. The personnel carrier of claim 17, wherein said steering means is connected to at least one faring member which functions as an air rudder to effect steering.

* * * * *